US005129879A

United States Patent [19]

Mattson

[11] Patent Number: 5,129,879

[45] Date of Patent: Jul. 14, 1992

[54] QUIET INCUBATOR LATCH

[75] Inventor: John S. Mattson, Mt. Airy, Md.

[73] Assignee: Boc Health Care, Inc., New Providence, N.J.

[21] Appl. No.: 605,626

[22] Filed: Oct. 30, 1990

[51] Int. Cl.[5] ..... A61G 11/00

[52] U.S. Cl. ..... 600/22; 292/DIG. 73; 292/DIG. 56

[58] Field of Search ..... 600/21-22; 292/173, DIG. 56, DIG. 73

[56] References Cited

U.S. PATENT DOCUMENTS

| | | | |
|---|---|---|---|
| 3,209,564 | 10/1965 | Pelcin | 292/173 |
| 3,782,141 | 1/1974 | Doerrfeld | 292/173 |
| 4,080,757 | 3/1978 | Westerman | 292/173 |
| 4,420,954 | 12/1983 | Hieronymi et al. | 292/173 |
| 4,773,392 | 9/1988 | Koch | 600/22 |
| 4,788,965 | 12/1988 | Milani et al. | 600/22 |
| 5,067,757 | 11/1991 | Cohrs et al. | 292/DIG. 73 |

*Primary Examiner*—Kyle L. Howell
*Assistant Examiner*—J. P. Lacyk
*Attorney, Agent, or Firm*—Roger M. Rathbun; Larry R. Cassett

[57] ABSTRACT

A handhole latch is disclosed for use with an infant incubator and which is damped by one or more elastomeric O-rings to reduce noise and vibration that could startle the infant. The O-rings are positioned between a moving piston latch and a housing such that the O-rings are sandwiched between the moving piston latch and the housing as the piston latch snaps, by spring bias, into its position holding the handhole door closed.

6 Claims, 2 Drawing Sheets

FIG. 1
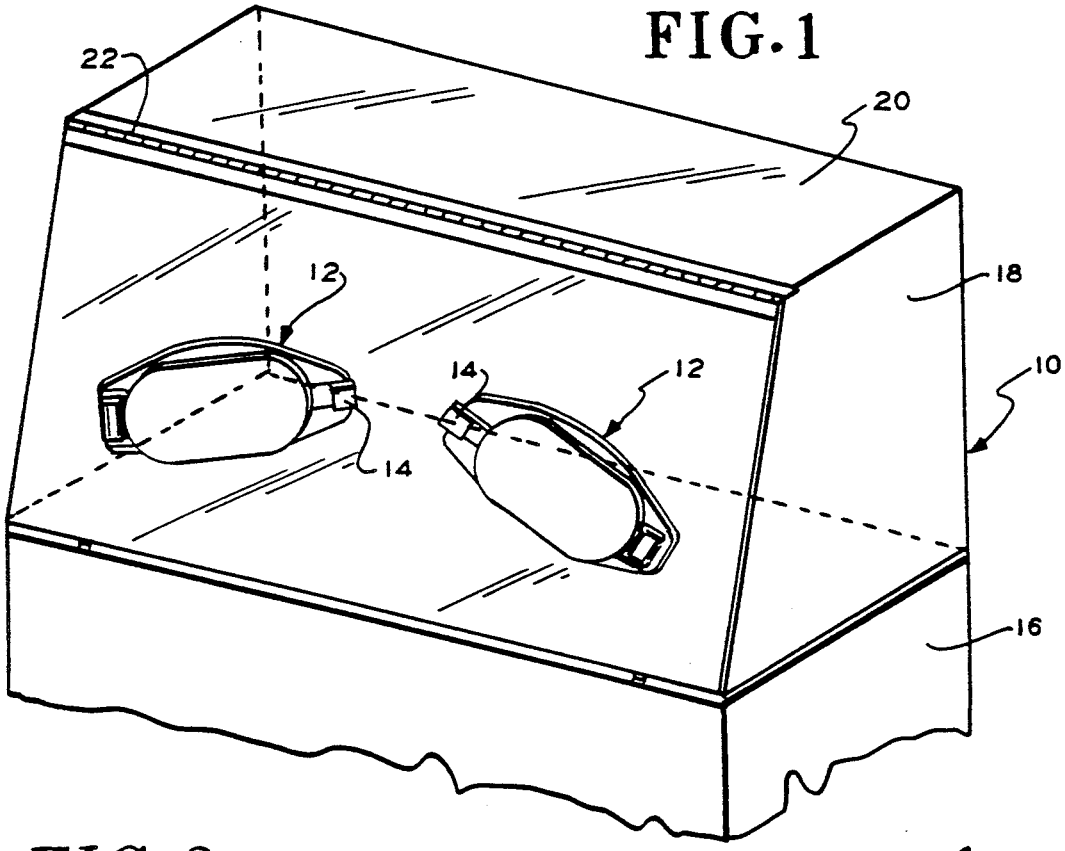
FIG. 3
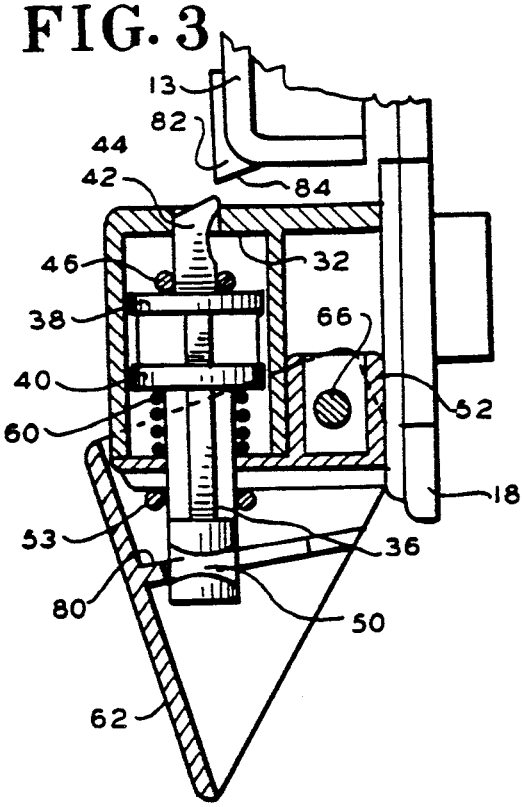
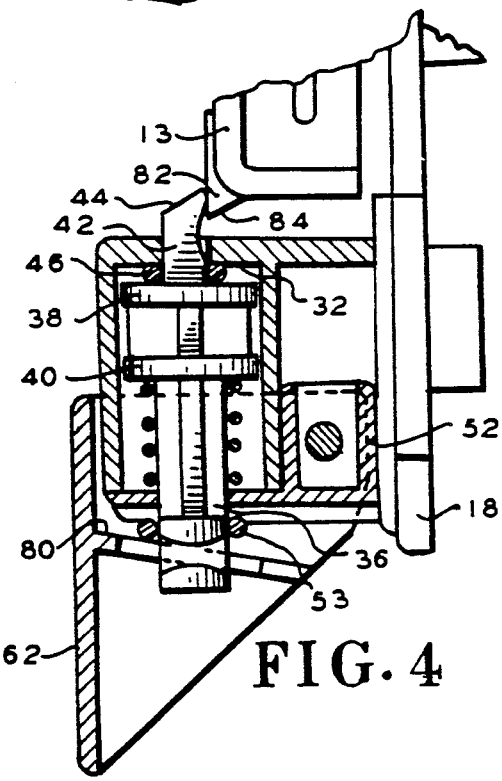
FIG. 4

QUIET INCUBATOR LATCH

BACKGROUND OF THE INVENTION

This invention relates to infant incubators and, more particularly, to a latch operable with a handhole door used to gain access to an infant positioned within the incubator.

Handholes are conventionally used with incubators and are basically small doors that are normally closed and are opened by hospital personnel so that the personnel can insert their hands into the incubator to attend to the needs of the infant.

Typical of such incubator handholes are found in U.S. Pat. No. 4,773,392 of Koch and assigned to the present assignee.

One current difficulty with such handholes involve the noise and vibration generated when the handhole door is snapped shut. Typical door latches are spring biased and when the door reaches the closed position, the latch mechanism moves to secure the door with a loud noise and accompanying vibration to the incubator.

Since the infant inside is obviously susceptible to noises, the closing of the handhole door frequently results in startling the infant and the infant jumps involuntarily.

The trauma and sudden movement of the infant is not desireable and thus the loud snapping action of the incubator handhole door latch is preferably eliminated.

SUMMARY OF THE INVENTION

The handhole door latch of the present invention thus provides a unique construction in which the overall latch is readily manufactured, fairly simple to assemble and install on an incubator and yet which incorporates a feature that allows quiet operation of the latch when the incubator handhole door is closed.

The latch comprises a latch housing that is adapted to be easily secured to the incubator hood. A piston latch is movably affixed within the latch housing and has a lip that extends outwardly from the latch housing and secures the handhole door closed.

An operating lever is pivotably mounted to the latch housing and may be depressed by an operator to withdraw the piston latch and its lip from its position overlapping the handhole door so that the door may be opened. When released, a spring biases the piston latch toward its forward position extending outwardly toward the handhole door.

A pair of elastomeric O-rings are provided that serve to dampen the otherwise abrupt movement of the piston latch. One O-ring interfits between the piston latch and a fixed surface of the latch housing and the other is positioned on the shaft of the piston latch. Both O-rings serve to cushion the movement of the piston latch as it moves by the spring bias toward its extended position. Thus, the piston latch moves forward fairly rapidly to secure the handhole door in the closed position, yet its movement is cushioned and dampened, thereby reducing the noise and vibration of such movement by relatively simple and inexpensive means.

The foregoing and other advantages and features of the present invention will become readily apparent from the following description.

BRIEF DESCRIPTION OF THE DRAWINGS

The invention is diagrammatically illustrated by way of example in the drawings appended hereto, in which:

FIG. 1 is an isometric view of an incubator having installed thereon, handhole door latches constructed in accordance with the present invention;

FIG. 3 is a side cross-sectional view of the incubator handhole door latch where the handhole door is in the open position;

FIG. 4 is a side cross-sectional view of the incubator handhole door latch holding the handhole door in its closed position.

DESCRIPTION OF THE PREFERRED EMBODIMENT

Figures 2, 5:
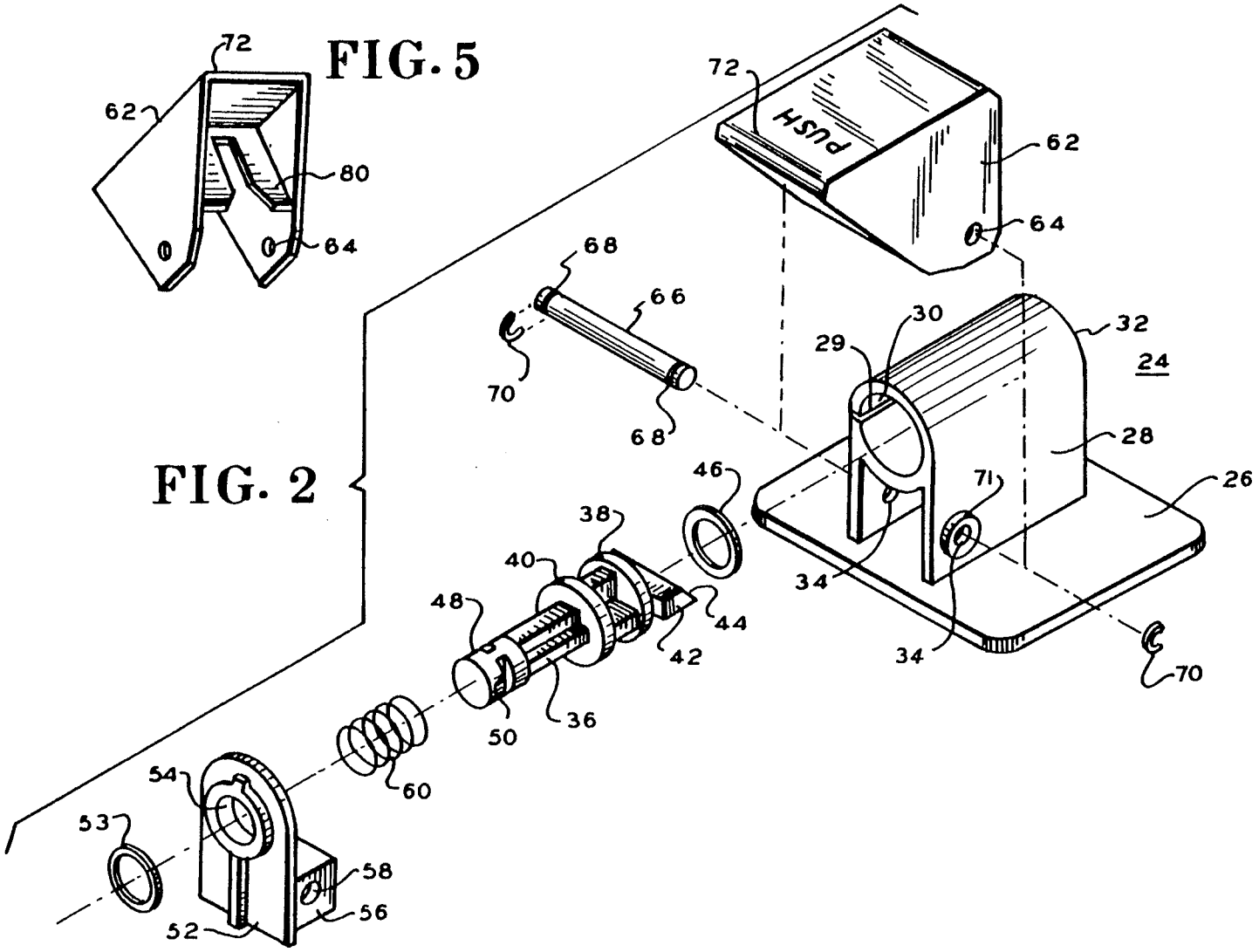
FIG. 2 is an exploded view of an incubator handhole door latch constructed in accordance with the present invention.
FIG. 5 is an isometric view of the underside of the operating lever used with the present invention.

Turning first to FIG. 1, there is shown an isometric view of an incubator 10 containing handholes 12 having doors 13 and latches 14 constructed in accordance with the present invention. In particular, incubator 10 comprises a base 16 and a hood 18 on top of the base 16 so as to enclose therein, an infant compartment 20 where the infant is confined in a specially controlled environment.

That environment generally includes a heated atmosphere as well as controlled humidification. In general, hoods and large access doors for such incubators are hinged, such as by piano type hinge 22 so that personnel can open the hood or door for complete access to the infant or for placing the infant in the incubator or removing the infant therefrom. Typical hinges are commonly also provided at the rear of the entire hood for access to the inside compartment.

As shown, therefore, the handhole 12 is readily accessible to be opened by hospital or other attending personnel and which personnel can insert their hands through the handholes 12 for access to the infant, yet by minimizing the opening size, only a minimum of disruption to the internal controlled environment occurs.

Turning now to FIG. 2, there is shown an exploded view of a handhole latch 14 constructed in accordance with the present invention.

A latch housing 24 is a one piece injection molded part of acetal polymer and including a housing flange 26 that attaches the handhole latch 14 to the incubator. Latch housing 24 further comprises an upstanding support 28 having a cylindrical opening 30 through support 28 and opening through a forward wall 32 within upstanding support 28 is a groove 29 along its interior length. Upstanding support 28 further has a pair of aligned holes 34, the purpose of which will be later explained.

A piston latch 36, also being a one piece molded plastic part fits movably within cylindrical opening 30 and includes a forward circular flange 38 and a rearward circular flange 40 of diameters slightly smaller than the inner diameter of circular opening 30 and spaced apart sufficiently to provide support and stability to piston latch 36 as it moves within cylindrical opening 30. In addition, a tab (not shown) is formed on one side of piston latch 36 that fits within groove 29 so that proper alignment of the piston latch 36 within cylindrical opening 30. By convention, herein, the term forward shall mean items disposed in the direction toward the incubator handhole door 13 (FIG. 1) and forward movement shall be intended to cover movement toward handhole door 13 (FIG. 1).

Piston latch 36 further includes a latch edge 42 that, when assembled protrudes through forward wall 32 and has an angled surface 44 as will be explained. An elastomeric O-ring 46 is fitted between the forward circular flange 38 and forward wall 32 and which cushions the impact of piston latch 36 when it is moved forwardly toward forward wall 32.

At the rear of piston latch 36, there is a circular end 48 having a predetermined diameter and having a pair of opposedly disposed grooves 50 (only one of which is shown in FIG. 2) found as rounded chords in circular end 48 of predetermined depth.

An end cap 52 covers the rearward end of upstanding support 28 and has a circular hole 54 through which circular end 48 projects; circular hub 54 having a predetermined diameter slightly larger than the outer diameter of circular end 48. Outside of end cap 52, there is provided another elastomeric O-ring 53 that is sized to fit snugly upon the circular end 48.

As assembled, end cap 52 has a flange 56 with a hole 58 therethrough and which aligns with the pair of aligned holes 34 in upstanding support 28 and a spring 60 is thereby compressed between end cap 52 and rearward circular flange 40 exerting a bias on piston latch 36 in the forward direction.

An operating lever 62, generally in the shape of a right triangle is pivotably mounted to upstanding support 28. As shown, the operating lever 62 has a pair of holes 64 (only one of which is shown in FIG. 2) that also align with the pair of aligned holes 34 of upstanding support 28.

As assembled, a pin 66 having a pair of oppositely disposed circular grooves 68 is fitted through the holes 64 of operating lever 62, the hole 58 in end cap 52 and the pair of aligned holes 34 in upstanding support 28 to secure those parts together and a pair of C clips 70 hold pin 66 in its desired position. Near pads 71, only one of which is shown in FIG. 2 are interposed between the upstanding support 28 and the C-clips 70 and enhance movement between operating lever 62 and upstanding support 28.

Thus it can be seen that, when handhole latch 14 is assembled, operating lever 62 pivots about pin 66 and can be readily moved by pressing on the rear portion of it's top side 72. As will later be seen, operating lever 62 is operatively connected to the piston latch 36 by means of oppositely disposed grooves 50 such that depressing top side 72 causes the piston latch 36 to move rearwardly against the bias of spring 60.

Turning to FIGS. 3, 4 and 5, in FIG. 3, there is shown a cross sectional view of the handhole latch 14 with the piston latch 36 in its rearward position, that is, when the top side 72 of operating lever 62 has been depressed by an operator, and in FIG. 4, there is shown a cross sectional view of the handhole latch 14 with the piston latch 36 in its forward position holding handhole door 13 in its closed position.

Taking first, FIG. 3, the interaction between operating lever 62 and the piston latch 36 can readily be seen. A bifurcated flange 80 (note FIG. 5) depends downwardly from the under surface of the top side 72 of operating lever 62 and straddles the oppositely disposed grooves 50 formed in the circular end 48 of piston latch 36. As can be seen, the grooves 50 are rounded such that the piston latch 36 can move in a lateral direction while bifurcated flange 80 moves in an arcuate path. The arc of the path of bifurcated flange 80 causes the lateral movement of piston latch 36, that is, as operating lever 62 is pushed downward, bifurcated flange 80 causes the piston latch 36 to move rearwardly with respect to the incubator handhole door 13 thereby moving the latch edge 42 away from engagement with lip 82 formed on handhole door 13. When the operating lever 62 is released, the bifurcated flange 80 springs against elastomeric O-ring 53, thereby cushioning the impact of the bifurcated flange 80 against end cap 52. As should be noted, lip 82 also has an angled surface 84 matching to some extent, the angled surface 44 of latch edge 42.

Turning finally to FIG. 4, it is noted that the piston latch 36 has moved to its forward position holding the handhole door 13 in its closed position. Generally, such handhole doors 13 are closed by pushing against the surface of the door to close the handhole opening. As handhole door 13 is closed, therefore, the angled surface 84 of lip 82 will ride along the angled surface 44 of piston latch 36, thereby pushing the piston latch 36 rearwardly against the bias of spring 60. When the handhole door 13 finally reaches its closed position, the piston latch 36 clears lip 82 and the bias of spring 60 snaps the piston latch 36 forwardly to its forward position as shown in FIG. 4 holding handhole door 13 closed.

As can be seen, however, elastomeric O-rings 46 and 53 halt the forward movement of piston latch 36. Elastomeric O-ring 46 is positioned between forward circular flange 38 and forward wall 32 and elastomeric O-ring 53 is positioned between bifurcated flange 80 and the end cap 52. Thus, the snapping movement of piston latch 36 is dampened by both elastomeric O-rings 46 and 53 and the overall closing operation for handhole door 13 does not cause loud sounds or vibrations that startle the infant.

While the invention has been disclosed and described with reference to a single embodiment, it will become apparent that variations and modifications may be made therein, and it is therefore intended in the following claims to cover each such variation and modification as falls within the true spirit and scope of the invention.

I claim:

1. A handhole door latch for allowing opening and closing of a handhole door on an infant incubator hood, said handhole door latch comprising a housing adapted to be secured to the incubator hood, said housing having an opening therethrough, a piston latch moveably secured within said housing and having a lip extending through said opening, said piston latch being moveable between a first position where said lip secures the handhole door in a closed position, and a second position where said handhole door may be opened, operating lever means to move said piston latch to said second position, a spring bias means within said housing and acting to bias said piston latch toward its first position, and an elastomeric material positioned between said piston latch and said housing such that said elastomeric material damps the vibrations and noise as said piston latch moves between its first and second positions.

2. A handhole door latch as defined in claim 1 wherein said spring bias means comprises a coiled spring contained within said housing and acting against said piston latch.

3. A handhole door latch as defined in claim 1 wherein said operating lever is pivotably affixed to said housing and engaging said piston latch.

4. A handhole door latch as defined in claim 1 wherein said elastomeric material comprises at least one O-ring.

5. A handhole door latch as defined in claim 4 wherein said elastomeric material comprises a pair of O-rings.

6. A handhole door latch for allowing opening and closing of a handhole door on an infant incubator hood, said handhole door latch comprising a housing adapted to be secured to the incubator hood, said housing having a circular opening therethrough, a piston latch moveably secured within said housing and having a lip extending through said opening, said piston latch having a pair of spaced circular flanges fitting within said circular opening to guide said piston latch, said piston latch being moveable between a first position where said lip secures the handhole door in a closed position, and a second position where said handhole door may be opened, operating lever means to move said piston latch to said second position, a spring bias means within said housing and acting to bias said piston latch toward its first position, and an elastomeric material positioned between one of said circular flanges of said piston latch and said housing and between said operating lever and said housing such that said elastomeric material damps the vibrations and noise as said piston latch moves between its first and second positions.

* * * * *